US012404636B2

(12) United States Patent
Carreon et al.

(10) Patent No.: US 12,404,636 B2
(45) Date of Patent: Sep. 2, 2025

(54) SPREADING MACHINES WITH IMPROVED CONTROLS

(71) Applicant: E.D. Etnyre & Co., Oregon, IL (US)

(72) Inventors: Eric A. Carreon, Sycamore, IL (US); Tyler Braun, Rockford, IL (US)

(73) Assignee: E.D. Etnyre & Co., Oregon, IL (US)

( * ) Notice: Subject to any disclaimer, the term of this patent is extended or adjusted under 35 U.S.C. 154(b) by 887 days.

(21) Appl. No.: 17/589,377

(22) Filed: Jan. 31, 2022

(65) Prior Publication Data

US 2023/0243111 A1 Aug. 3, 2023

Related U.S. Application Data

(63) Continuation of application No. 29/824,503, filed on Jan. 25, 2022.

(51) Int. Cl.
*E01C 19/21* (2006.01)
*E01C 19/08* (2006.01)

(52) U.S. Cl.
CPC ..... *E01C 19/21* (2013.01); *E01C 19/08* (2013.01)

(58) Field of Classification Search
CPC ..... E01C 19/08; E01C 19/21
USPC ..... 404/75, 104–108, 111, 118
See application file for complete search history.

(56) References Cited

U.S. PATENT DOCUMENTS 3,239,148 A 3/1966 Etnyre
4,817,870 A 4/1989 Dalton
4,960,242 A 10/1990 Larson
5,234,128 A 8/1993 Hill
5,419,654 A 5/1995 Kleiger
5,575,583 A * 11/1996 Grembowicz ..... E01C 19/48 404/72
5,851,085 A * 12/1998 Campbell ..... E01C 19/4853 404/110
5,895,173 A 4/1999 O'Brian et al.
6,805,516 B2 10/2004 Barnat et al.
7,802,737 B2 9/2010 Rayner
(Continued)

FOREIGN PATENT DOCUMENTS

FR 2873722 A1 * 2/2006 ..... E01C 19/21
WO WO2021102501 6/2021

OTHER PUBLICATIONS

Rosco, a LeeBoy Company, Maximizer 2B Asphalt Distributor, BR-7001.5-EN, 2 pages.
(Continued)

*Primary Examiner* — Raymond W Addie
(74) *Attorney, Agent, or Firm* — Hinshaw & Culbertson LLP; Roger M. Masson, Esq.

(57) ABSTRACT

A vehicle for distributing a fluid or a solid material on or into the ground has one or more axles for supporting the vehicle on the ground, a vessel for holding the material to be spread on or into the ground, and a plurality of valves for controlling the lateral extent of distribution of the material on or into the ground. The vehicle may have a plurality of control switches for controlling the lateral extent of distribution of material and operative to control the opening and closing of different valves or different groups of valves of the plurality of valves. The vehicle may have an indicator for each valve or group of valves, the indicator operative to provide different indications for a plurality of different statuses for the corresponding valve or valves.

20 Claims, 5 Drawing Sheets

(56) References Cited

U.S. PATENT DOCUMENTS

| | | | | |
|---|---|---|---|---|
| 2003/0223816 | A1* | 12/2003 | Potts | E01C 19/288 404/117 |
| 2009/0257824 | A1* | 10/2009 | Musil | E01C 19/174 404/101 |
| 2014/0099165 | A1* | 4/2014 | Smieja | E01C 19/48 404/72 |
| 2021/0102346 | A1 | 4/2021 | Spray | |
| 2021/0113977 | A1* | 4/2021 | Shi | B01F 27/116 |

OTHER PUBLICATIONS

Rosco, a LeeBoy Company, Maximizer 3B Asphalt Distributor, BR-7002.5-EN, 2 pages.
Rosco, a LeeBoy Company, Maximizer 4B Asphalt Distributor, BR-7003.3-EN, 2 pages.
Rosco, a LeeBoy Company, Product Specifications Maximizer 4B Distributor, SS-7003.3-EN, 4 pages.
Rosco, a LeeBoy Company, CSV Variable Width Chip Spreader, CSV Brochure No. BR-8003.6-EN, 2 pages (2020).
Rosco, a LeeBoy Company; Operations, Service and Parts Manual; Rosco CSV Variable Width Chip Spreader, CSV Manual No. 1014011-02, 356 pages (2019).

* cited by examiner

SPREADING MACHINES WITH IMPROVED CONTROLS

CROSS REFERENCE TO RELATED APPLICATIONS

This application is a continuation of U.S. application Ser. No. 29/824,503 filed Jan. 25, 2022, which is incorporated by reference herein in its entirety.

FIELD OF THE INVENTION

The invention relates to spreading machines, such as asphalt distributors and chip spreaders, having controls for controlling the width and location of spreading.

BACKGROUND

Spreading machines are used in a variety of fields, such as road maintenance and agriculture. The width of spread often has to be adjusted during spread. For example, if a machine is being used to plant seeds in a field that is not rectangular, it is advantageous to be able to adjust the spread to maximize the amount of field planted while minimizing the seeds wasted. Similarly, road maintenance machines such as asphalt distributors and chip spreaders, may be used on roads whose width varies such as in corners, intersections, or with the addition or subtraction of lanes in the road.

To be able to achieve the desired width or placement of material being spread, such machines may have one or more banks of toggle switches. Each toggle switch controls the spreading of a certain segment of the width of spread. An operator of such a machine often has at best an obstructed view of the actual spreading and often relies on the position of the toggle switch to know where the spread is occurring.

However, the installation of these switches is labor-intensive. Additionally, these switches if they break can result in costly downtime. A need therefore exists for an improved bank of switches.

So-called taper switches have begun to become popular with operators. The taper switch allows the width of spread to be adjusted without having to locate the specific toggle switch that controls the specific segment. However, the position of the toggle switch will then not correspond to whether or not the spreading is occurring at the corresponding segment. A need therefore exists for indicating what segments are spreading.

SUMMARY OF THE INVENTION

One embodiment of the invention is a vehicle for distributing a fluid or a solid material on or into the ground. The vehicle can be in the form of a tractor-trailer or a truck, for example. The vehicle has one or more axles for supporting the vehicle on the ground and a vessel for holding a material to be spread on or into the ground. The material can be a fluid or a flowable solid. The vehicle has a plurality of valves for controlling the lateral extent of distribution of the material on or into the ground and a control panel for controlling the lateral extent of distribution of material. The control panel has a plurality of dedicated switches. Each of the dedicated switches has an open position and a closed position. The dedicated switches are operative to respectively control the opening and closing of different valves of the plurality of valves. The dedicated switches are plugged into an electronic bus on a circuit board.

The vehicle may have a plurality of spray nozzles. Each of the valves are in fluid communication with one or more of the spray nozzles. The spray nozzles are arranged laterally to distribute material across the maximum lateral extent of distribution when all of the valves are open. The vehicle may also have a heater for the vessel and a pump operable to pump liquid from the vessel through the open control valves and out the corresponding nozzles. The heater may be electric or may burn a fuel like propane, gasoline or diesel.

Alternatively, the vehicle may have an elongated hopper having a lateral length to effect the maximum lateral extent of distribution when all of the valves are open. Each valve includes a gate at the bottom of the elongated hopper. The vehicle may also have a conveyor for moving solid material from the vessel to the spread hopper. The vessel may have an open top for receiving solid material from a dump truck or a live bottom trailer. The vessel may also be elongated.

The dedicated switches are replaceable by unplugging an existing dedicated switch and plugging in a new dedicated switch in its place.

The vehicle may have a taper switch operative to increase or decrease the lateral extent of distribution while overriding the dedicated switches. The taper switch could be located in the control panel or elsewhere.

The vehicle may also have an indicator for each of the dedicated switches. The indicators are operative to provide different indications for a plurality of different statuses for the valve or valves corresponding to each dedicated switch. The indicators may be located in the control panel and adjacent the corresponding dedicated switch. An indicator is typically illuminated, and may be a light like an LED, but could instead be a portion of a long LCD strip, typically along a bank of the dedicated switches. Alternatively, it could be particular spots on a screen, typically along a bank of the dedicated switches. The indicators could also be built in the dedicated switches.

The indications may include an indication for material being distributed through the corresponding valve or valves. This indication could be flashing green. Another possible indication is that of the corresponding valve or valves being closed because the dedicated switch is in the off position. This indication could be red. Another indication is that of the corresponding valve or valves being closed, but the corresponding dedicated switch being in the open position. This indication could be amber in color. The vehicle may also have a pump or a conveyor for moving material from the vessel for distribution. The control panel may also have a pump or conveyor switch that has an on position and an off position and is operative to turn the pump or conveyor on or off. Another indication is one when the corresponding dedicated switch is in the on position, but the pump or conveyor switch is in the off position. This indication can be green in color.

The vehicle may also have a taper switch operative to increase or decrease the lateral extent of distribution overriding the dedicated switch positions. Another indication is one indicating the inner most dedicated switch overridden by the taper switch. This indication can be blue in color.

Another embodiment of the invention is a vehicle for distributing a fluid or a solid material on or into the ground. The vehicle can be in the form of a tractor-trailer, a truck, or a specialized vehicle, for example. The vehicle has one or more axles for supporting the vehicle on the ground. The vehicle has a vessel for holding the material to be spread on or into the ground, a plurality of valves for controlling the lateral extent of distribution of the material on or into the ground, and a plurality of control switches for controlling the lateral extent of distribution of material and operative to control the opening and closing of different valves or different groups of valves of the plurality of valves. The control switches may be part of a control panel. The control switches are intended to be used by an operator of the vehicle to control the opening and closing of different valves or different groups of valves of the plurality of valves. The vehicle also has an indicator for each valve or group of valves. The indicators are operative to provide different indications for a plurality of different statuses for the corresponding valve or valves. The number of valves in a group is generally less than 6 and the number of indicators is generally above 6. The number of different indications may be 5 or less, but could exceed 5.

The control switches may include a taper switch operative to increase or decrease the lateral extent of distribution. The increase or decrease changes the status of one or more valves, e.g., opens or closes one or more of the valves. Typically, there are two taper switches, one for each side of the vehicle.

The indications for the indicators may include an indication for material being distributed through the corresponding valve or valves, which can be flashing green, and an indication that the corresponding valve or valves are open, but there is no flow of material from the vessel to the valves, such as when a pump or conveyor for moving the fluid or solids from the tank has not been turned on. This latter indication can be solid green. The control switches may include a taper switch operative to increase or decrease the lateral extent of distribution and wherein the indications further comprise an indication indicating the corresponding valve or valves are turned off by operation of the taper switch. This indication may be amber. The indications may include an indication indicating the corresponding valve or valves is the inner most valve or valves turned off by operation of the taper switch. This indication may be blue. The control switches may include a plurality of dedicated switches, each of the dedicated switches having an open position and a closed position which are operative to respectively control the opening and closing of different valves of the plurality of valves. The indications may also include an indication of the corresponding valve or valves being closed because the corresponding dedicated switch is in the off position. This indication may be red.

The vehicle may include spray nozzles. Each of the valves is in fluid communication with one or more of the spray nozzles. The spray nozzles are arranged laterally to distribute material across the maximum lateral extent of distribution when all of the valves are open. Typically the spray nozzles are arranged on a spray bar. The vehicle may have a heater for the vessel and a pump operable to pump liquid from the vessel through the valves that are open and out the corresponding nozzles.

The vehicle may have an elongated hopper having a lateral length to effect the maximum lateral extent of distribution when all of the valves are open. Each valve has a gate at the bottom of the spread hopper. The hopper may be extendable. The vehicle may have a conveyor for moving solid material from the vessel to the hopper. The vessel may have an open top for receiving solid material from a dump truck or a live bottom trailer.

DETAILED DESCRIPTION OF THE INVENTION

Figure 1:
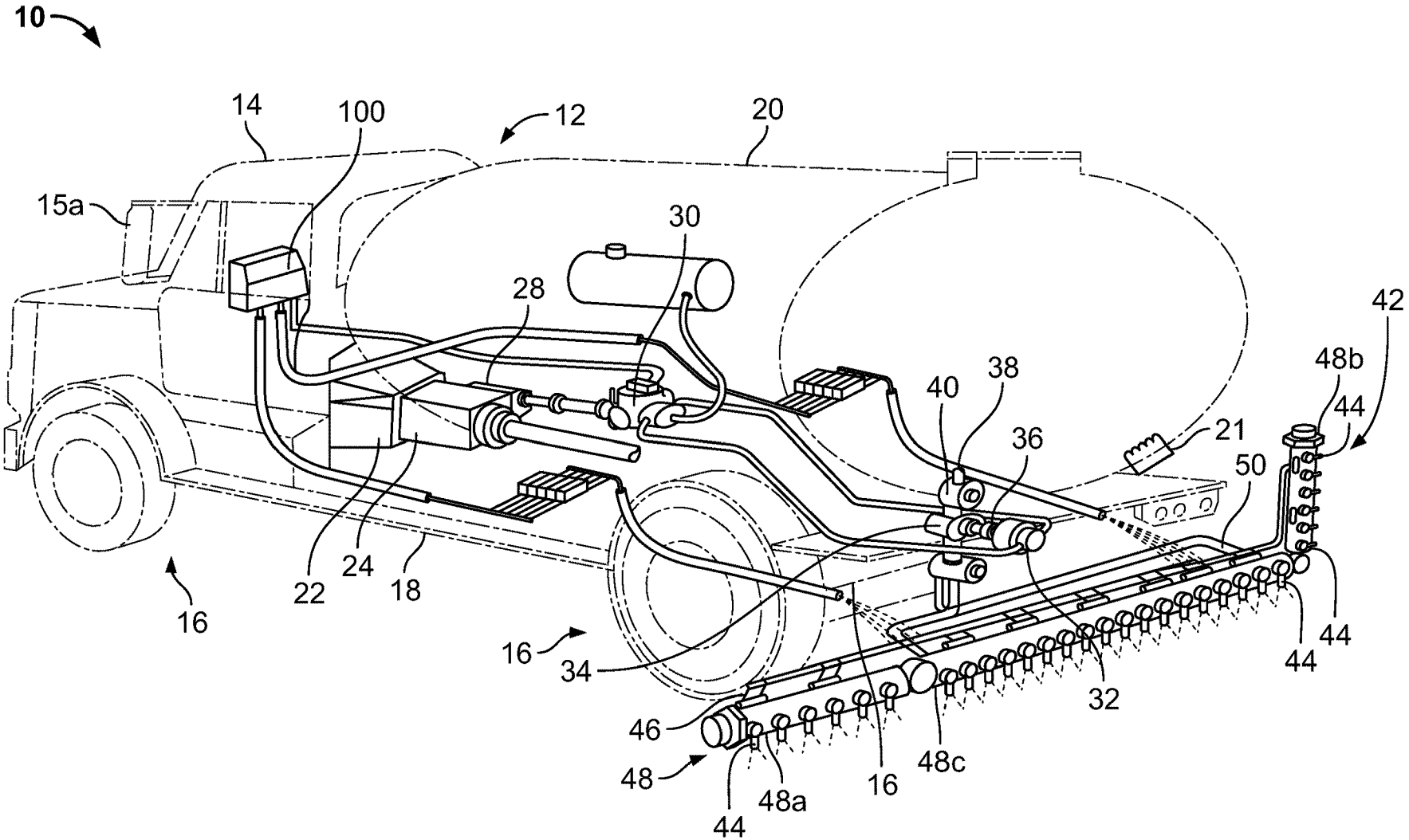
FIG. 1 is a perspective view of a fluid distributor. Wings should be 2 feet long with 6 sprays and center bar should be 8 ft wide with 24 valves.

In a first embodiment of the invention, a fluid distributor 10 is provided. Fluid distributor 10 includes a motorized vehicle 12 (shown in phantom), typically a truck, having a cab 14, one or more side view mirrors 15, two or more axles 16, a chassis 18, and a tank or vessel 20 mounted to chassis 18. Tank 20 is used to store the fluid to be distributed. Tank 20 may be heated by a heater 21 of any suitable kind. Heater 21 is shown schematically as an electric heater. The fluid may be gas, liquid or combinations thereof. The liquid may be asphalt, water, aqueous solutions, slurries, coatings, or emulsions. In a preferred embodiment, the liquid is asphalt and fluid distributor 10 is an asphalt distributor, an example of which is described in U.S. Pat. No. 4,817,870, which is incorporated herein by reference.

Fluid distributor 10 has an engine 22 (shown schematically), which drives a transmission 24 (shown schematically) and a power-take-off drive 28 off of transmission 24, which in turn drives a hydraulic drive pump 30, which in turn drives hydraulic motor 32, which in turn drives fluid pump 34 via gear box 36. Fluid pump 34 need not be driven as described. Any suitable drive can be used such as an electric motor for pump 34. Pump 34 may be of any suitable type. Preferably, it is of the constant displacement type. Fluid pump 34 draws fluid from tank 20 via an intake port 38 having an intake valve 40. For simplicity, FIG. 1 does not show additional ports such as a return port that are conventional.

Fluid pump 34 pumps fluid from tank 20 to a fluid distribution system 42 located at the rear end of vehicle 12. Working from the end backwards, fluid distribution system 42 has spray nozzles 44 (or outlets) for spraying the fluid, control valves 46, spray bar 48, and conduit/piping system means 50. Spray nozzles 44 are arranged on spray bar 48, typically uniformly spaced along spray bar 48. Instead of spray nozzles 44, any suitable applicator for applying fluid may be used. For example, the applicator can be an injector such as those used to inject ammonia into soil for agricultural applications or to spray nutrient solutions. Spray bar 48 may be extendable or fixed. Fixed spray bars have a length that typically is approximately the same as or narrower than vehicle 12. Extendable spray bars of any suitable design are designed to extend beyond the width of vehicle 12 in operation, but to retract to be at or less than the width of vehicle 12 for ease of transportation. As shown, spray bar 48 is extendable having pivotal end portions 48*a* and 48*b* and a central portion 48*c*. Pivotal end portions are sometimes called spray bar wings. Alternatively, spray bar 48 could be a variable width spray bar having central portion 48*c* and end portions that move in and out in several positions. End portion 48*a* is shown in the extended position with spraying occurring in FIG. 1 while end portion 48*b* is shown in the retracted position with no spraying occurring. Central portion 48*c* is shown spraying. Spray bar 48 may be located at the front end or the rear of vehicle 12. Flow of fluid to spray nozzles 44 is controlled by control valves 46. In one embodiment, there are three spray nozzles 44 per foot of spray bar 48 and one control valve 46 per spray nozzle 44. Other arrangements are also contemplated, such as one valve 46 controlling the flow through three spray nozzles 44. Fluid distribution system 42 has the necessary conduit, whether tubing, hoses, piping or mixtures thereof for connecting distribution system 42 together.

Fluid distributor 10 has a control panel 100 for controlling the distribution of fluid. Control panel 100 is typically located in cab 14 so that the operator of fluid distributor 10 can drive vehicle 12 while controlling the distribution of fluid via control valves 46.

Figure 2:
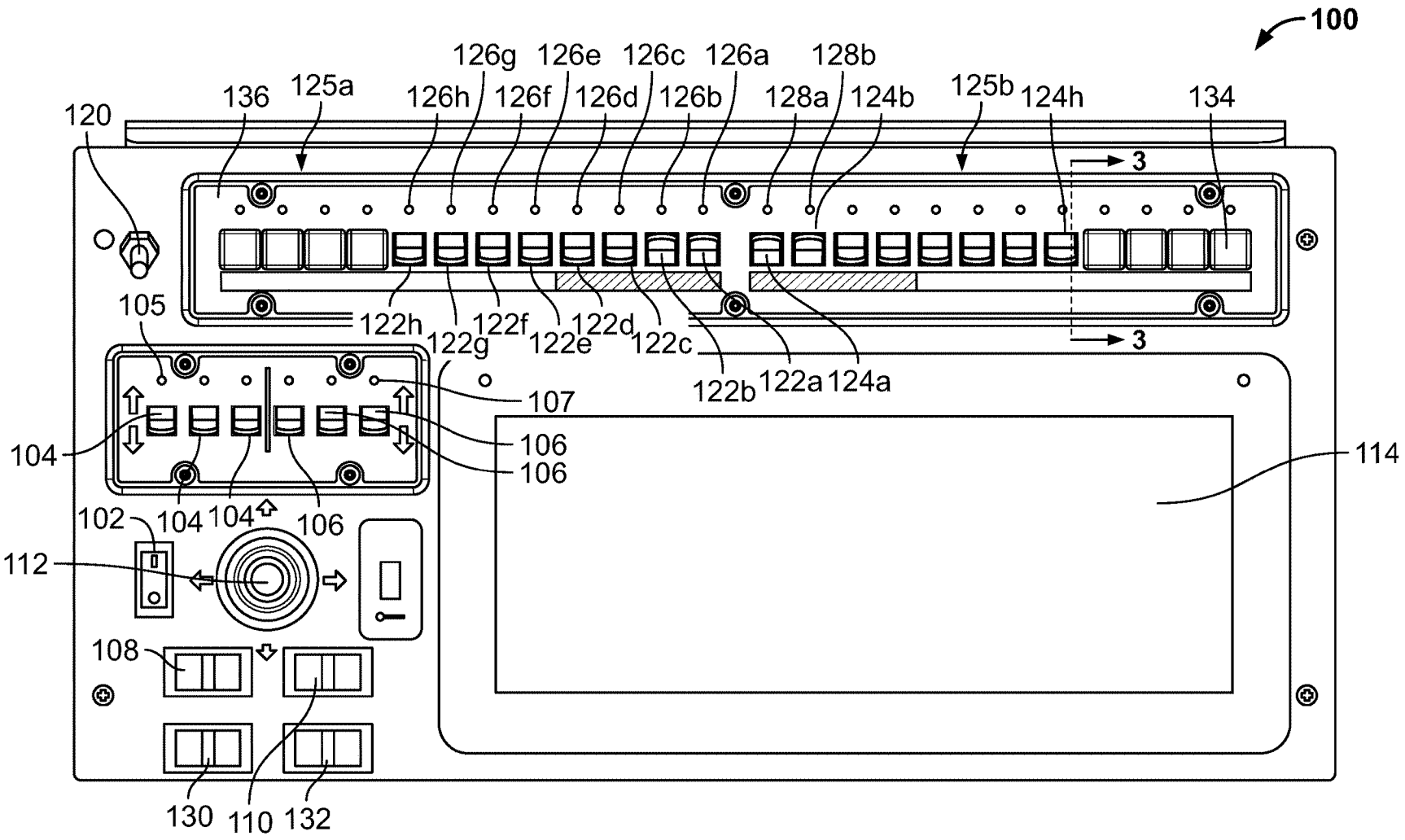
FIG. 2 is a front view of a control panel of the fluid distributor of FIG. 1.

Control panel 100 as shown in FIG. 2 has a master power switch 102, switches 104 and 106 for controlling spray bar wings 48*a* and 48*b*, indicators 105 and 107, switches 108 and 110 for controlling the extension and retraction of end portions of a variable width spray bar 48, a joystick 112, and a screen 114. Master power switch 102 turns on and off power to control panel 100. Switches 104 and 106 raise and lower spray bar wings 48*a* and 48*b*, respectively. Spray bar wings 48*a* and 48*b* raise so that they can be out of the way when not in use and lower so they can be used for spraying fluid into the ground. There are multiple switches 104 and 106 in case end portions 48*a* and 48*b* having more than one segment. Indicators 105 and 107 correspond to switches 104 and 106 and indicate whether end portions 48*a* and 48*b* are raised or lowered. Joystick 112 allows spray bar 48 to be moved up, down, right and left as needed. Screen or display 114 can be used to show various operating parameters and available functions. In addition, the screen allows for the operator to input application specific settings for items such as flow and speed. Also, the screen allows for the display of machine diagnostics. Display 114 can display a rear view from a rear view camera (not shown).

Control panel 100 has a master spray switch 120, dedicated spray switches 122 and 124 arranged in banks 125*a* and 125*b*, indicators 126 and 128 (also arranged in banks 125*a* and 125*b*), taper switches 130 and 132, and empty slots 134. Master spray switch 120 operates to turn on and off fluid pump 34. Dedicated spray switches 122 in bank 125*a* and spray switches 124 in bank 125*b* have on and off positions that operate to turn on and off control valves 46 on the left and right side of vehicle 12, respectively. Switches 122*a*, 122*b*, 124*a* and 124*b* are shown in the on position. The other switches 122 and 124 are shown in the off position. One switch 122 or 124 can operate one or more valves 46. In a preferred embodiment, one switch 122 or 124 controls three valves 46 and each valve 46 is connected to one spray nozzle 44 (note that FIGS. 1 and 2 do not necessarily have a matched number of switches to valves).

Indicators 126 and 128 are located immediately above dedicated spray switches 122 and 124 and provide indications representing the status of control valves 46. For example, indicator 126*a* provides an indication of the status of the one or more control valves 46 controlled by switch 122*a* and indicator 128*a* provides an indication of the status of the one or more control valves 46 controlled by switch 124*a*. Indicator 126 and 128 can be any suitable kind of indicator that lets an operator of fluid distributor 10 know the status of control valves 46. In a preferred embodiment, indicators 126 or 128 are multicolor LEDs, one for each switch 122 and 124, to show at least some of the different statuses using different colors. Alternatively, an elongated LED or LCD display (not shown) could have multiple portions that constitute indicators 126 and 128. As shown each indicator 126 and 128 is located directly above and in registry with corresponding switches 122 and 124. It is contemplated that indicators 126 and 128 can be located in a different location (outside of control panel 100) or that there can be duplicate indicators 126 and 128 located not adjacent to switches 122 and 124. For example, indicators 126 or duplicate indicators 126 can be located in side view mirror 15*a* on the left side and indicators 128 or duplicates can be located in side view mirror 15 on the right side such that an operator can look in one of side view mirrors 15 to check the spraying and also see the indications. The indicators 126 and 128 that are located (or duplicated) in side view mirrors 15 may be limited to those that correspond to the spray nozzles whose sprays can be seen in the side view mirrors 15. Similarly, indicators 126 and 128 or duplicates may be located in display 114 when display 114 shows views from a rear view camera in which case switches 122 and 124 may also be located in registry along display 114.

Taper switches 130 and 132 are operative to override the dedicated switches 122 and 124 to turn on and off control valves 46. In one alternative, taper switches 130 and 132 can only override only the dedicated switches that are in the on position. Conceivably, the overriding could be partial. In other words, if each dedicated switch 122 or 124 controls three control valves 46, taper switches 130 and 132 could override dedicated switches 122 or 124 as to one control valve 46 at a time thereby achieving individualized control over control valves 46. In another alternative, taper switches 130 and 132 can override the dedicated switches regardless of the position they are in. Taper switches 130 and 132 are preferably rocker switches, which return to a central position after being pushed.

Figure 3:
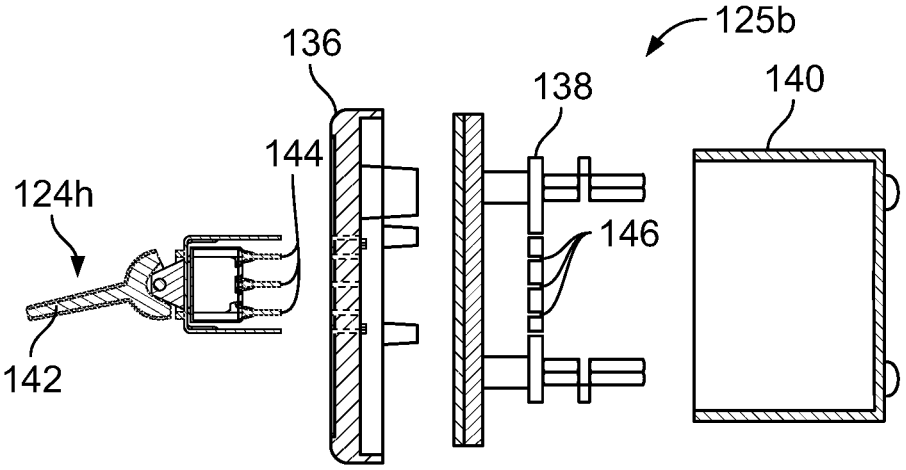
FIG. 3 is a schematic exploded side view of a module of the control panel of FIG. 2 taken along line 3-3.
Figure 4:
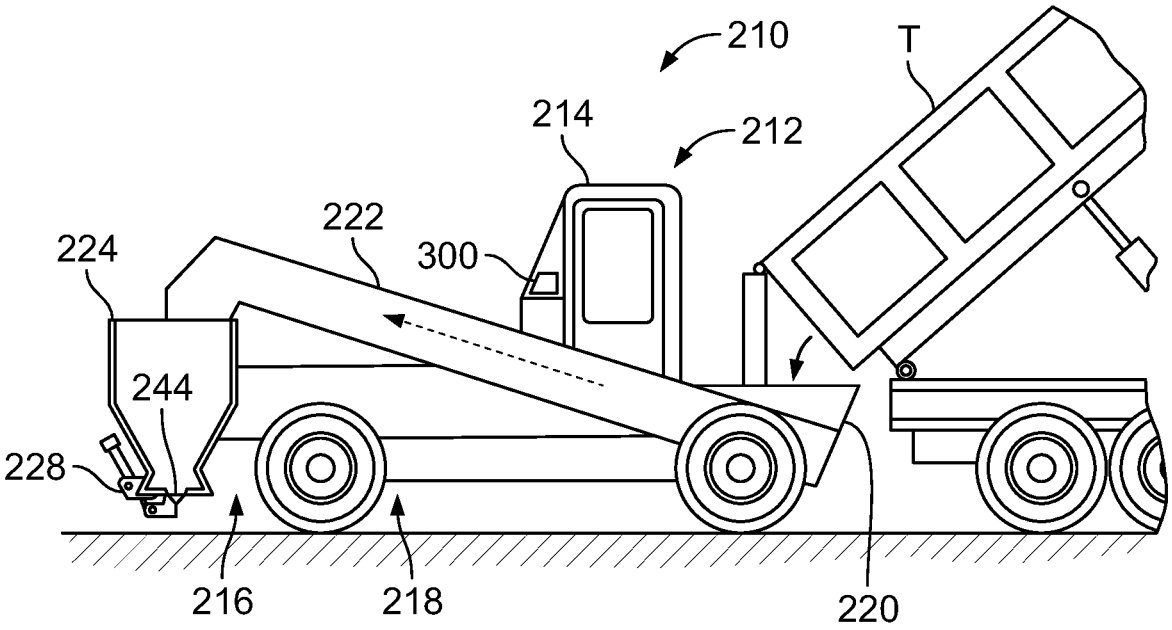
FIG. 4 is a side view of a solids distributor.

FIG. 3 is an exploded cross-sectional view of bank 125*b*. Bank 125*a* and bank 125*b* are substantially identical and are preferably just different halves of the same bank 125. Bank 125*b* includes switches 124, a faceplate 136 shared with bank 125*a*, a printed circuit board 138, and a case 140. Switch 122/124 is preferably a maintained rocker or toggle switch having a lever 142 and electrical male contacts 144. Switches 122 and 124 are plugged/press fit into printed circuit board 138 having female contacts 146 for male contacts 144. Board 138 has a controller area network (CAN) bus. Preferably bank 125 is available as a CAN module. Advantageously, bank 125 has a number of slots for accommodating a typical maximum number of switches 122/124 for ease of manufacturing. Preferably, bank 125 has 8 or more slots (note that CAN modules having more than 4 slots were not previously commercially available), more preferably 18-30 slots, and most preferably 24 slots. In practice, this means that bank 125 has switches 122 and 124 and may have one or more empty slots 134. Bank 125 advantageously eliminates the need to individually wire each switch 122/124 as in the prior art. Furthermore, if a switch 122 or 124 breaks, it is a simple matter for an operator to replace the broken switch by unplugging it and plugging in a new one. Previously, the operator would have had to unsolder the broken switch and solder in the new switch often at great delay.

In operation, operator of fluid distributor 10 first prepares distributor 10 for distributing the fluid in vessel 20. Depending on the width of the road onto which asphalt is to be sprayed on, end portions 48*a* or 48*b* may be lowered (fully or partially) by switches 104 and 106 for spray wings or be extended by switches 108 and 110 for extendable spray bars. Next, switches 122 and 124 can be flipped to the on position or off position to match the desired width of spraying, but spraying has not started because master spray switch 120 is in the off position. Indicators 126 and 128 corresponding to switches 122 and 124 that are in the on position are solid green or are amber if the switches are overridden. Switches 122 and 124 may be overridden because the corresponding spray nozzles 44 are not in position for spraying, i.e., the spray nozzles are on an end portion 48*a* or 48*b* that has not been lowered or extended. Switches 122 and 124 may also be overridden by operation of taper switches 130 and 132, respectively, discussed later. The remaining indicators are off if there is no corresponding switch 122 or 124.

Once preparations are complete, the operator can drive distributor 10 and then turn on master spray switch 120 at the appropriate time to start spraying. At this time, all indicators 126 and 128 that were solid green are now flashing green indicating that the fluid is being sprayed out corresponding spray nozzles 44. Indicators that were off or amber continue to be off or amber. No fluid is being distributed through nozzles 44 that correspond to indicators 126 and 128 that are amber. The operator can adjust the spray width as necessary by feel, specifically, the operator can feel switches 122 and 124 and from their position, on or off, and location determine which ones need to be changed.

Alternatively, the operator can use one or both taper switches 130 and 132 to adjust the spray width. Hypothetically, assume that switches 122*a*-122*f* are in the on position and indicators 126*a*-126*f* are flashing green indicating that fluid is being spray through the corresponding spray nozzles 44, while switches 122*g* and 122*h* are in the off position and indicators 126*g* and 126*h* are red indicating that there is no spraying through the corresponding spray nozzles 44. If the operator wants to reduce the extent of spray on the left side of fluid distributor 10, the operator can press taper switch 130 to the right once. This results in indicator 126*f* turning blue and the corresponding control valves 46 closing. The blue of indicator 126*f* indicates that spray switch 122*f* is the inner most switch 122 overridden by operation of taper switch 130. If the operator wants to reduce the extent of spray on the left side of fluid distributor 10 again, the operator can press taper switch 130 to the right. This results in indicator 126*e* turning blue and indicator 126*f* turning amber and the corresponding control valves 46 being closed. Taper switch 130 can continue to be pressed to the right until indicators 126*b*-126*f* are all amber and indicator 126*a* is blue in which case control valves 46 for the left side of distributor 10 will be closed. Pushing taper switch 130 to the right does not affect the status of valves 46 controlled by control switches 122*g* and 122*h*; also indicators 126*g* and 126*h* remain red. Taper switch 130 can be pressed left to reverse the effect of pressing taper switch to the right. Taper switch 130 can be pressed left causing the indicator that is blue "to move left" like a cursor until the indicators 126 for all the switches 122 that are in the on position are green. Taper switch 132 works the same with respect to control switches 124 and indicators 128 for the right side of distributor 10. Indicators 126 and 128 therefore provide easy to understand statuses for control valves 46 and spray nozzles 44.

Conceivably, if taper switches 130 allow individualized control over valves 46 assuming switches 122 do not allow individualized control, indicators 126 could show a hybrid status of green (or flashing green) and blue when the corresponding switch 122 has been overridden as to some control valves 46, but not others.

EXAMPLE OF FLUID DISTRIBUTOR—In a preferred example, fluid distributor 10 is used to spray asphalt onto a road. Distributor 10 has a heater 21 for keeping asphalt liquid. Spray bar 48 when fully extended is approximately 24 feet wide, each portion 48*a*, 48*b* and 48*c* being eight foot long. Each portion 48*a*, 48*b* and 48*c* has 24 spray nozzles 44 connected to 24 control valves 46. Bank 125 has 12 switches 122 and 12 switches 124. In other words each switch 122 or 124 has three corresponding spray nozzles 44 and three corresponding control valves 46.

In a second embodiment of the invention, a solids distributor 210 is provided. Solids distributor 210 includes a motorized vehicle 212 having optionally a cab 214, two or more axles 216, a chassis 218, and a vessel 220 mounted to chassis 218. Vessel 220 is used to hold the solids to be distributed. Vessel 220 may be open top (as shown) or closed top. Vessel 220 may be heated by a heater of any suitable kind. The solids may vary in size from a fine powder, pellets, to coarse aggregates and may include a variety of different sizes. The solids may be seeds, fertilizer, aggregate, gravel, sand or combinations thereof, for example. In a preferred embodiment, the solids are gravel or aggregate and solids distributor 10 is a chip spreader, an example of which is described in U.S. Pat. No. 5,234,128, which is incorporated herein by reference.

Figure 5:
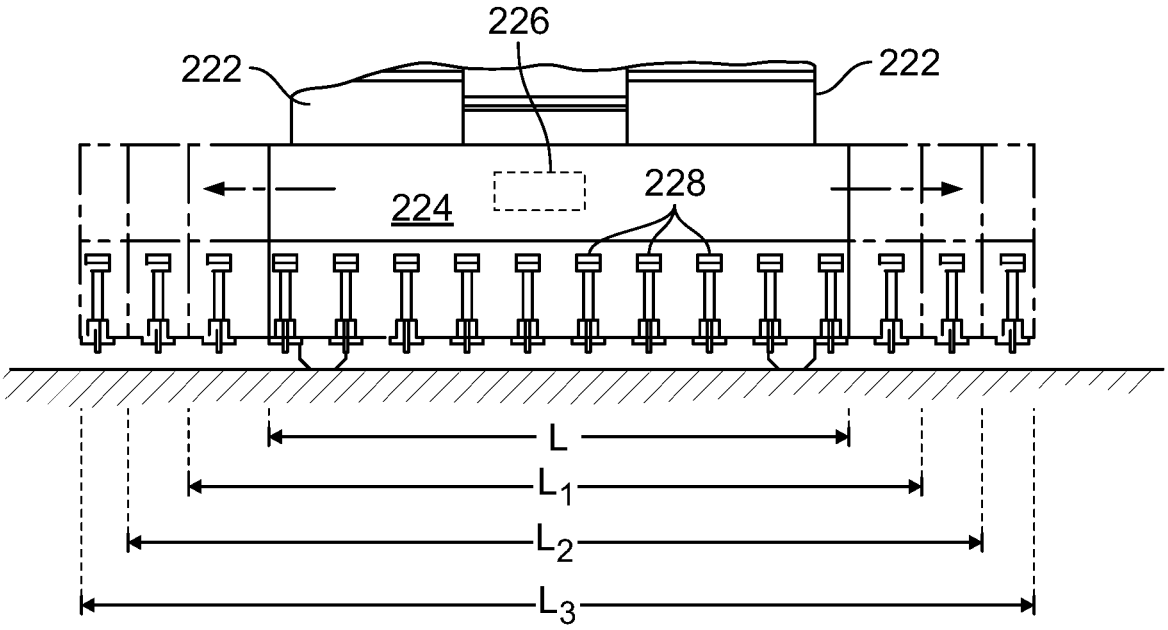
FIG. 5 is a front view of the solids distributor of FIG. 4.
Figure 6:
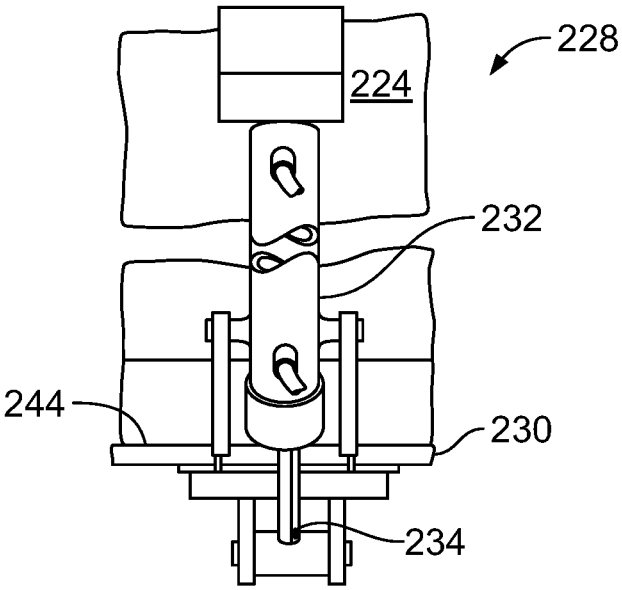
FIG. 6 is a magnified view of a control valve shown in FIG. 5.
Figure 7:
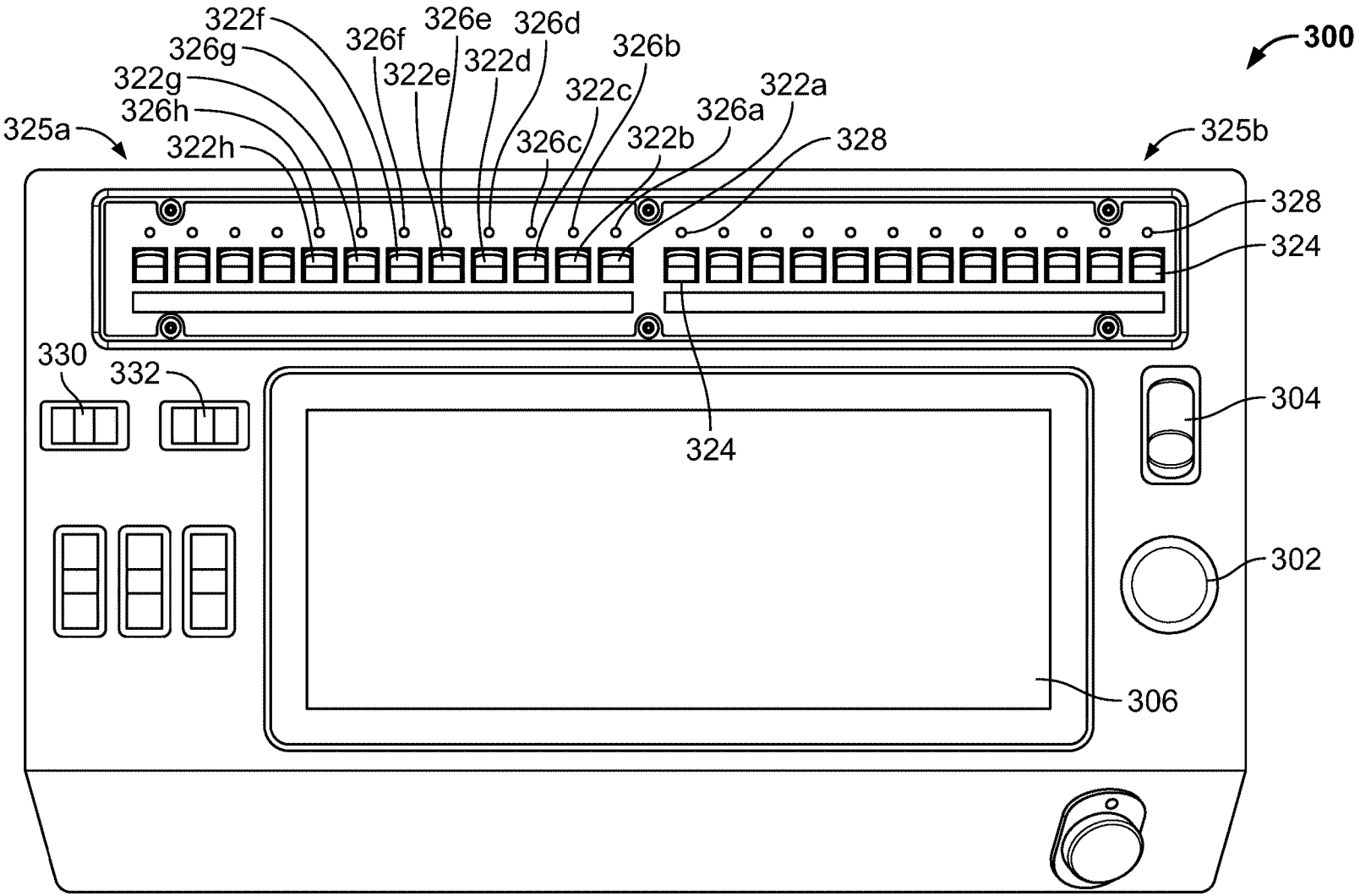
FIG. 7 is a front view of a control panel of the solids distributor of FIG. 4.

Solids distributor 210 has a conveyor system 222 for moving the solids from vessel 220 to an elongated hopper 224 (or vessel). Conveyor system 222 (shown schematically) may be made of any suitable conveyor or combinations thereof including screw conveyors, belt conveyors, bucket conveyors, vibrating conveyors, pneumatic conveyors, and combinations thereof. Conveyor system can include parallel conveyors as shown schematically in FIG. 5 for better distributing solids into spread hopper. Hopper 224 receives the solids conveyed by conveyor system 222. Hopper 224 has optionally a vibrator 226 (shown schematically) to better distribute solids within hopper 224 and a plurality of control valves 228 located at the bottom of hopper 224. Control valves 228 may be any suitable valve for the solids to be distributed. As shown, control valves 228 are of the gate variety having a gate 230 and a cylinder 232 having a piston 234. Extension and retraction of piston 234 causes gate 230 to pivotally close and open, respectively, over an outlet 244 of hopper 224. Alternatively, gate 230 can be a sliding gate. Cylinder 232 may be pneumatic or hydraulic. Hopper 224 has outlets 244 at the bottom, one outlet 244 for each valve 228. Outlets 244 may be continuous such that they are not distinct from each other, but are separate only to the extent that they are closed by different valves 228. Outlets 244 as shown are upstream of valves 228, but can be downstream.

Elongated hopper 224 has a width L in its most compact form for transportation purposes. It may be extended on both sides usually by same amount to have widths L1, L2 or L3 to match the desired lateral extent of distribution. It may be necessary depending on the design of hopper 224 to remove or install control valves 228 to change the width or lateral length of hopper 224.

Solids distributor 210 has a control panel 300. Control panel has an emergency stop button 302, a display power button 304 and a display 306. The purpose of display power button 304 is to turn on and off display 306. Display 306 is preferably a touch screen display permitting an operator to control application settings such as type of solid to be spread, solid size (e.g., gravel size), ground speed, and application rate. Display 306 can also display operating parameters, available functions, and machine diagnostics. Control panel 300 also has dedicated spreading switches 322 and 324 arranged in banks 325*a* and 325*b*, respectively, and corresponding indicators 326 and 328, respectively. Dedicated spreading switches 322 and 324, banks 325*a* and 325*b*, and indicators 326 and 328, may be the same or similar to dedicated spray switches 122 and 124, banks 125*a* and 125*b*, and indicators 126 and 128. Control panel 300 also has taper switches 332 that are the same or similar to taper switches 132. Bank 325 may have empty slots (not shown) like empty slots 134 for bank 125.

In operation, operator of fluid distributor 210 first prepares distributor 210 for distributing the solids in vessel 220. This may include adjusting the length of vessel to meet or exceed the maximum desired width of spreading, say L1, for example. Next, switches 322 and 324 can be flipped to the on position or off position to match the desired width of spreading. Indicators 326 and 328 corresponding to switches 322 and 324 that are in the on position are solid green or are amber if the switches are overridden. Switches 322 and 324 may be overridden because vessel 220 may not have been elongated sufficiently that the corresponding gates 230 are not in position for spraying, i.e., control valves 228 shown on either end of vessel 224 for lengths L2 and L3 are not in position to be used. Switches 322 and 324 may also be overridden by operation of taper switches 330 and 332, respectively, discussed later. The remaining indicators 326 and 328 are off if there is no corresponding switch 322 or 324.

Once preparations are complete, the operator can drive solids distributor 210 and then turn on the appropriate controls via touch screen 306 at the appropriate time to start spraying. At this time, all indicators 326 and 328 that were solid green are now flashing green indicating that the solids are being distributed out of corresponding valves 228 and outlets 244. Indicators 326 and 328 that were off or amber continue to be off or amber. No solids are distributed through outlets 244 that correspond to indicators 326 and 328 that are amber. The operator can adjust the spray width as necessary by feel, specifically, the operator can feel switches 322 and 324 and from their position, on or off, and location determine which ones need to be changed.

Alternatively, the operator can use one or both taper switches 330 and 332 to adjust the distribution width. Hypothetically, assume that switches 322*a*-322*f* are in the on position and indicators 326*a*-326*f* are flashing green indicating that solids are being distributed spray through outlets 244, while switches 322*g* and 322*h* are in the off position and indicators 326*g* and 326*h* are red indicating that there is no distribution through the corresponding outlets 244. If the operator wants to reduce the extent of spray on the left side of solids distributor 210, the operator can press taper switch 330 to the right once. This results in indicator 326*f* turning blue and the corresponding valves 228 closing. The blue of indicator 326*f* indicates that spray switch 322*f* is the inner most switch 322 overridden by operation of taper switch 330. If the operator wants to reduce the extent of spray on the left side of solids distributor 210 again, the operator can press taper switch 330 to the right. This results in indicator 326*e* turning blue and indicator 326*f* turning amber and the corresponding control valves 228 being closed. Taper switch 330 can continue to be pressed to the right until indicators 326*b*-326*f* are all amber and indicator 326*a* is blue in which case control valves 228 for the left side of distributor 210 will be closed. Pushing taper switch 330 to the right does not affect the status of valves 228 controlled by control switches 322*g* and 322*h*; also indicators 326*g* and 326*h* remain red. Taper switch 330 can be pressed left to reverse the effect of pressing taper switch to the right. Taper switch 330 can be pressed left causing the indicator that is blue "to move left" like a cursor until indicators 326 for all the switches 322 that are in the on position are green. Taper switch 332 works the same with respect to control switches 324 and indicators 328 for the right side of distributor 210. Indicators 326 and 328 therefore provide easy to understand statuses for control valves 228 and outlets 244.

EXAMPLE OF SOLIDS DISTRIBUTOR—In a preferred example, solids distributor 210 is used to spread chips onto a road. Vessel 220 has an open top for receiving aggregate from a dump truck T or a live bottoms trailer. Elongated hopper 224 is approximately 24 feet wide when fully extended and has 24 outlets 244 and 24 control valves 228. Bank 325 has 12 switches 322 and 12 switches 324. In other words, each switch 322 or 324 has one corresponding outlet 244 and one corresponding control valve 228.

While the invention has been described with respect to certain embodiments, as will be appreciated by those skilled in the art, it is to be understood that the invention is capable of numerous changes, modifications and rearrangements, and such changes, modifications and rearrangements are intended to be covered by the following claims.

What is claimed is:

1. A vehicle for distributing a fluid or a solid material on or into the ground, the vehicle comprising:

one or more axles for supporting the vehicle on the ground;

a vessel for holding the material to be spread on or into the ground;

a plurality of valves for controlling the lateral extent of distribution of the material on or into the ground; and a control panel for controlling the lateral extent of distribution of material, the control panel having a plurality of dedicated switches, each of the dedicated switches having an open position and a closed position, which are operative to respectively control the opening and closing of different valves of the plurality of valves, the dedicated switches plugged into an electronic bus on a circuit board, the vehicle further comprising a taper switch operative to control the opening of an outermost closed valve of the plurality of valves and the closing of an outermost open valve of the plurality of valves to incrementally increase or decrease the lateral extent of distribution while overriding the dedicated switches, wherein repeated operation of the taper switch to increase the lateral extent repeatedly increasing the lateral extent of distribution until a maximum lateral extent of distribution is achieved on one side of the vehicle.

2. The vehicle of claim 1 further comprising a plurality of spray nozzles, each of the valves in fluid communication with one or more of the spray nozzles, the spray nozzles being arranged laterally to distribute material across the maximum lateral extent of distribution when all of the valves are open.

3. The vehicle of claim 2 further comprising a heater for the vessel and a pump operable to pump liquid from the vessel through the open control valves and out the corresponding nozzles.

4. The vehicle of claim 1 further comprising an indicator for each of the dedicated switches, the indicator operative to provide different indications for a plurality of different statuses for the valve or valves corresponding to each dedicated switch.

5. The vehicle of claim 4 wherein the indications comprise an indication for material being distributed through the corresponding valve or valves, an indication of the corresponding valve or valves being closed by operation of the dedicated switch is in the off position, and an indication of the corresponding valve or valves being closed, but the corresponding dedicated switch is in the open position.

6. The vehicle of claim 4 further comprising a pump or a conveyor for moving material from the vessel for distribution, wherein the control panel further comprises a pump or conveyor switch having an on position and an off position and operative to turn the pump or conveyor on or off and the indications further comprise an indication that the corresponding dedicated switch is in the on position, but the pump or conveyor switch is in the off position.

7. The vehicle of claim 4 wherein the indications further comprise an indication indicating the inner most dedicated switch overridden by the taper switch.

8. A vehicle for distributing a fluid or a solid material on or into the ground, the vehicle comprising:

one or more axles for supporting the vehicle on the ground;

a vessel for holding the material to be spread on or into the ground;

a plurality of valves for controlling the lateral extent of distribution of the material on or into the ground; and a control panel for controlling the lateral extent of distribution of material, the control panel having a plurality of dedicated switches, each of the dedicated switches having an open position and a closed position, which are operative to respectively control the opening and closing of different valves of the plurality of valves, the dedicated switches plugged into an electronic bus on a circuit board, the vehicle of further comprising an elongated hopper having a lateral length to affect the maximum lateral extent of distribution when all of the valves are open, each valve comprising a gate at the bottom of the elongated hopper.

9. The vehicle of claim 8 further comprising a conveyor for moving solid material from the vessel to the spread hopper.

10. The vehicle of claim 9 wherein the vessel has an open top for receiving solid material from a dump truck or a live bottom trailer.

11. A vehicle for distributing a fluid or a solid material on or into the ground, the vehicle comprising:

one or more axles for supporting the vehicle on the ground;

a vessel for holding the material to be spread on or into the ground;

a plurality of valves for controlling the lateral extent of distribution of the material on or into the ground; and a control panel for controlling the lateral extent of distribution of material, the control panel having a plurality of dedicated switches, each of the dedicated switches having an open position and a closed position, which are operative to respectively control the opening and closing of different valves of the plurality of valves, the dedicated switches plugged into an electronic bus on a circuit board, wherein the dedicated switches are replaceable by unplugging an existing dedicated switch and plugging in a new dedicated switch in its place.

12. A vehicle for distributing a fluid or a solid material on or into the ground, the vehicle comprising:

one or more axles for supporting the vehicle on the ground;

a vessel for holding the material to be spread on or into the ground;

a plurality of valves for controlling the lateral extent of distribution of the material on or into the ground;

a plurality of control switches for controlling the lateral extent of distribution of material and operative to control the opening and closing of different valves or different groups of valves of the plurality of valves; and an indicator for each valve or group of valves, wherein there are a plurality of indicators, the indicators operative to provide different indications for a plurality of different statuses for the corresponding valve or valves, the indications comprising an indication for material being distributed through the corresponding valve or valves, and an indication that the corresponding valve or valves are open, but there is no flow of material from the vessel to the valves.

13. The vehicle of claim 12 wherein the control switches further comprise a taper switch operative to increase or decrease the lateral extent of distribution and wherein the indications further comprise an indication indicating the corresponding valve or valves are turned off by operation of the taper switch.

14. The vehicle of claim 13 wherein the indications further comprise an indication indicating the corresponding valve or valves is the innermost valve or valves turned off by operation of the taper switch.

15. The vehicle of claim 13 wherein the control switches comprise dedicated switches, each of the dedicated switches having an open position and a closed position which are operative to respectively control the opening and closing of different valves of the plurality of valves, wherein the indications further comprise an indication of the corresponding valve or valves being closed because the corresponding dedicated switch is in the off position.

16. The vehicle of claim 12 further comprising a plurality of spray nozzles, each of the valves in fluid communication with one or more of the spray nozzles, the spray nozzles being arranged laterally to distribute material across the maximum lateral extent of distribution when all of the valves are open.

17. The vehicle of claim 16 further comprising a heater for the vessel and a pump operable to pump liquid from the vessel through the valves that are open and out the corresponding nozzles.

18. The vehicle of claim 12 further comprising an elongated hopper having a lateral length to affect the maximum lateral extent of distribution when all of the valves are open, each valve comprising a gate at the bottom of the spread hopper.

19. The vehicle of claim 18 further comprising a conveyor for moving solid material from the vessel to the hopper.

20. The vehicle of claim 19 wherein the vessel has an open top for receiving solid material from a dump truck or a live bottom trailer.

* * * * *